US006146114A

United States Patent [19]

Nardacci et al.

[11] Patent Number: 6,146,114

[45] Date of Patent: Nov. 14, 2000

[54] FLUID PUMP AND EXPANDABLE ENERGY STORAGE DEVICE

[75] Inventors: Nicholas M. Nardacci, Bristol; Jeffrey L. Cipolla, Newport, both of R.I.

[73] Assignee: The United States of America as represented by the Secretary of the Navy, Washington, D.C.

[21] Appl. No.: 09/090,223

[22] Filed: May 22, 1998

[51] Int. Cl.[7] ..... F04B 19/00

[52] U.S. Cl. ..... 417/437; 92/90; 92/130 B

[58] Field of Search ..... 417/328, 471, 417/437; 92/89, 90, 91, 130 B

[56] References Cited

U.S. PATENT DOCUMENTS 2,298,756 10/1942 Erickson ..... 417/471
4,833,973 5/1989 Wang ..... 92/90
5,230,276 7/1993 Collett ..... 92/90

*Primary Examiner*—Charles G. Freay
*Attorney, Agent, or Firm*—Michael J. McGowan; Robert W. Gauthier; Prithvi C. Lall

[57] ABSTRACT

A fluid pump and expandable energy storage device includes a substantially rigid circular band, a substantially rigid central hub, a membrane fixed to the band and to the hub, the membrane being enlargeable by a fluid introduced into the device, and a plurality of rods interconnecting the band and the hub. The enlargeable membrane is adjacent the rods, such that enlargement of the membrane causes movement of the hub and portions of the rods away from a plane of the band. The movement causes twisting and bending of the rods, biasing the rods to return to their original positions upon release of the fluid. Upon such release, the membrane and the rods immediately return to their non-enlarged states, forcing the fluid out of the device at a high velocity.

12 Claims, 6 Drawing Sheets

FLUID PUMP AND EXPANDABLE ENERGY STORAGE DEVICE

STATEMENT OF GOVERNMENT INTEREST

The invention described herein may be manufactured and used by and for the Government of the United States of America for Governmental purposes without the payment of any royalties thereon or therefor.

BACKGROUND OF THE INVENTION

1. Field of the Invention

The invention relates to fluid pumps, and is directed more particularly to a fluid pump and expandable energy storage device.

2. Description of the Prior Art

High impulse, short duration fluid pumps are known in the art and are used in submarine torpedo launch systems. Usually, such pump systems require high power piston or turbine machinery to provide the required high velocity fluid flow in a very short time. An attractive alternative to high-powered machines are relatively simple elastic bulbs which expand to contain a volume of fluid, such as sea water, under pressure. Upon release of the water, the bulb quickly returns to its non-expanded state, propelling the water at a high velocity into and through a torpedo tube to effect launch of a torpedo, or other missile, therein.

Fluid pumps and expandable energy storage devices are shown and described in U.S. Pat. No. 4,848,210, issued Jul. 18, 1989, in the name of Laurent C. Bissonnette, and U.S. Pat. No. 5,200,572, issued Apr. 6, 1993 in the name of Laurent C. Bissonnette et al.

In the '210 patent there is disclosed a bladder device for storing potential energy when distended and rapidly converting that stored energy into kinetic energy of a working fluid, for quietly ejecting a projectile from a launch system into a surrounding fluid medium. In the '572 patent there is disclosed an elastomeric impulse energy storage and transfer system including an accumulator body of elastomeric material, the body having an opening at a base portion thereof, and having in elevation an ellipsoidal configuration. The body receives and discharges fluid through the opening and is expandable and contractible in response to receiving and discharging, respectively, the fluid. The body retains the ellipsoidal configuration when in an expanded condition. A submarine projectile launch system includes the accumulator body as a component thereof.

An innate difficulty in structuring such pump and storage devices is in the provision of an elastomeric bulb or disc adapted to contain a large volume of relatively incompressible liquid at pressure sufficiently high to propel the liquid at a high velocity. The bulbs or discs typically are provided with thick elastomeric walls which undergo large strains in the accomodation of the requisite fluid volume. An elastomeric wall for such an application has demanded compromises in the selection of material for reliability, durability, strain energy capacity, fracture toughness, and chemical resistance. Further, such elastomeric bulbs require a relatively large volume of space, always at a premium in submarines.

Accordingly, there is a need for a fluid pump and expandable energy storage device which provides reliability and durability, which provides the required strain energy and which provides the required volume of fluid but with reduced strain levels in the elastomeric, energy-storing members.

SUMMARY OF THE INVENTION

An object of the invention is, therefore, to provide a fluid pump and expandable energy storage device which is reliable and durable, and which, with limited levels of strain, provides the necessary strain energy to propel a large volume of fluid.

With the above and other objects in view, as will hereinafter appear, a feature of the present invention is the provision of a fluid pump and energy storage device comprising a substantially rigid circular band, a substantially rigid hub disposed centrally of the band, a membrane fixed to the band and to the hub, the membrane being enlargeable by a fluid introduced into the device, and a plurality of rods interconnecting the band and the hub. The enlargeable membrane is adjacent the rods, such that enlargement of the membrane causes movement of the hub and portions of the rods away from a plane of the band. The rods undergo axial torsion as the membrane expands and are thus biased to return to their original positions, whereby upon release of the fluid, the membrane and the rods immediately return to their non-enlarged states, forcing the fluid out of the device at a high velocity.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

Figure 1:
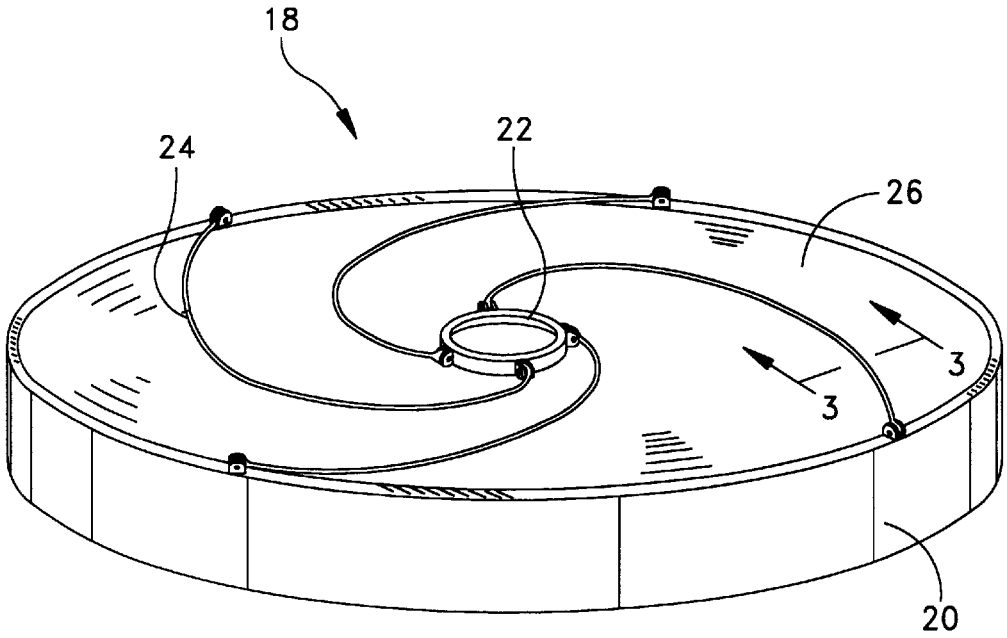
FIG. 1 is a perspective view of one form of fluid pump and expandable energy storage device in a non-expanded condition, illustrative of an embodiment of the invention.

Referring to FIG. 1, it will be seen that an illustrative fluid pump and expandable energy storage device 18 includes a substantially rigid circular band 20 and a substantially rigid central hub 22, which may be of an annular configuration, as illustrated, or of a disc-like structure (not shown). The band 20 and hub 22 are interconnected by spirally wound rods 24.

Figure 2:
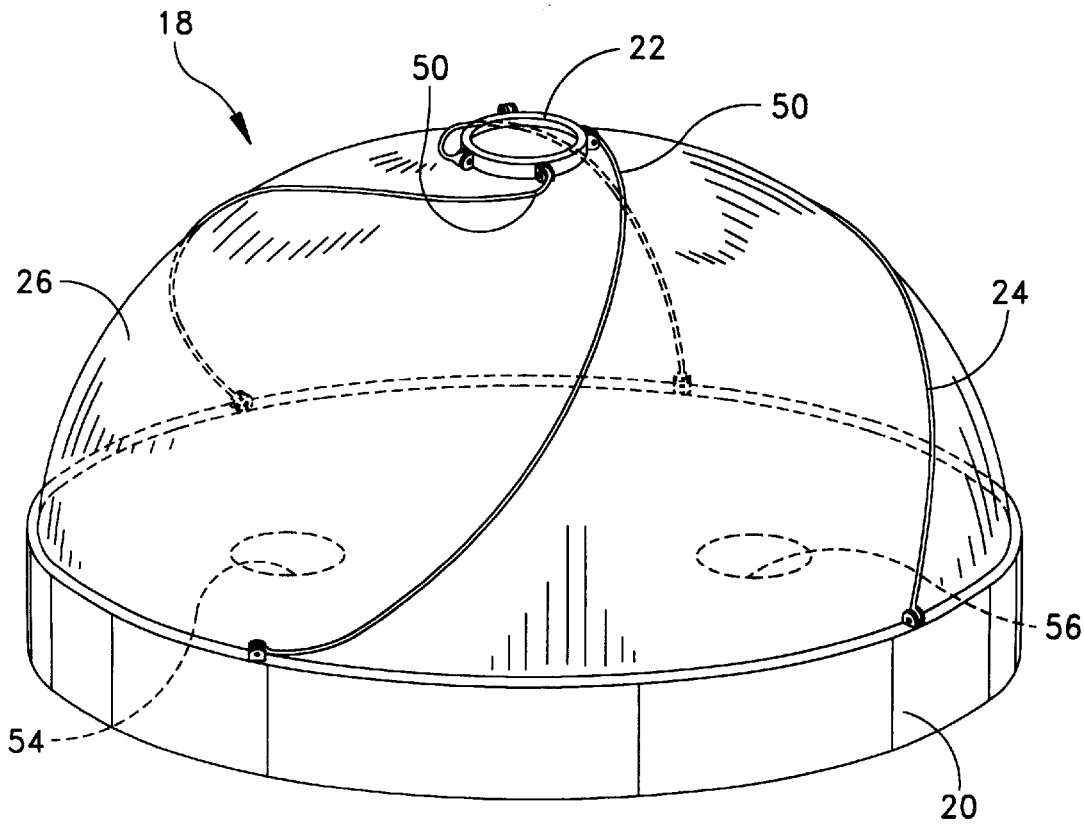
FIG. 2 is similar to FIG. 1 but illustrative of the fluid pump in an expanded condition.
Figure 3:
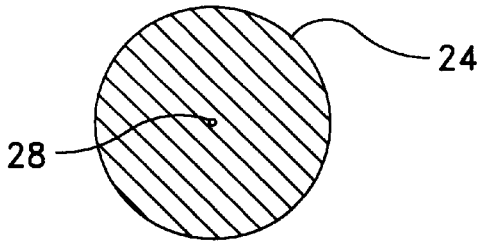
FIG. 3 is a sectional view of a rod portion of the pump of FIG. 1, taken along line III—III of FIG. 1.

A membrane 26 is fixed at its periphery to band 20 and is disposed beneath rods 24 and hub 22, such that expansion or enlargement of membrane 26 causes the pump 18 to assume the configuration shown in FIG. 2, in which rods 24 are flexed upwardly and are twisted along their axes 28 (FIG. 3) in the process of expansion of membrane 26.

In preferred embodiments, rods 24 are round (FIG. 3) and are of steel or titanium, or alloys of steel and/or titanium, or composites of metal and/or plastics or other synthetic materials, and membrane 26 is of an elastomeric material. Alternatively, membrane 26 may be of a substantially non-elastic material but of sufficient size to enlarge when filled with fluid, such as seawater, or the like.

Figure 4:
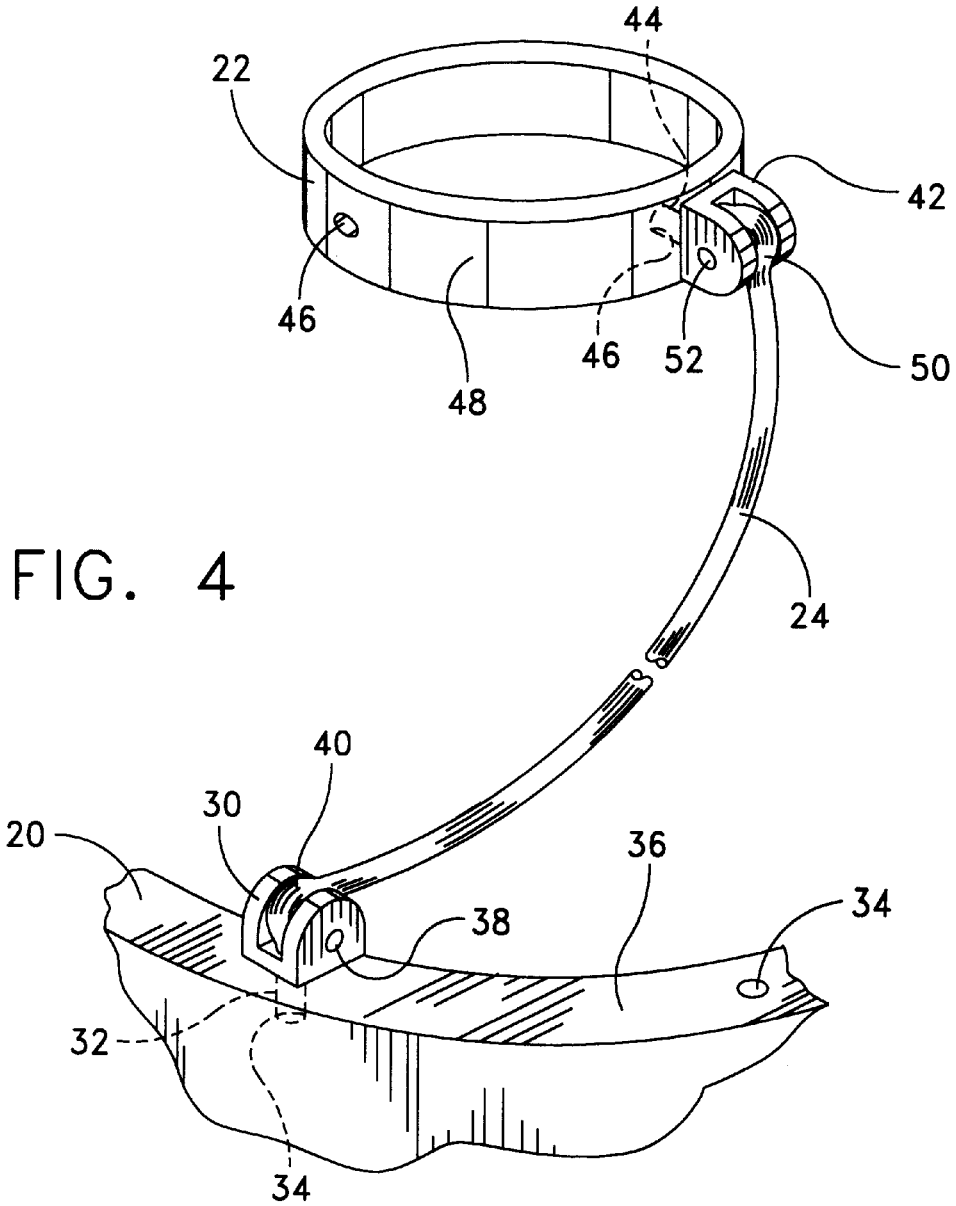
FIG. 4 is a perspective view of a pin mounting arrangement for a rod portion of the pump of FIG. 1.

Referring to FIG. 4, it will be seen that in a preferred embodiment rods 24 are each attached to band 20 by a clevis 30 supported by a post 32 rotatably mounted in a bore 34 in a top surface 36 of band 20. A pin 38 pivotally retains an outer end 40 of each of the rods 24. Thus, outer end 40 of each rod 24 is pivotal about the axis of post 32 and is pivotal about the axis of pin 38, but is not rotatable about its own axis 28. Similarly, rods 24 are each attached to hub 22 by a clevis 42 supported by a post 44 rotatably mounted in a bore 46 in an outer surface 48. A pin 52 pivotally retains an inner end 50 of each of the rods 24. Accordingly, inner end 50 of each of the rods 24 is pivotal about the axis of post 44 and is pivotal about the axis of pin 52, but is not rotatable about its own axis 28.

The pump and storage device may be fixed to a tank (not shown) or may be in communication with a tank and provided with an inlet 54 (FIG. 2) for receiving fluid from the tank, and an outlet 56 in communication with a missile launch tube (not shown), such as a torpedo tube or a vertical launch tube. Alternatively, a single orifice may serve as both inlet and outlet, as disclosed in the aforementioned patents to Bissonnette.

In operation, fluid, such as seawater, is flowed through inlet 54 and into the device of FIG. 1, causing membrane 26 to expand to the generally hemispherical configuration shown in FIG. 2. As membrane 26 expands, or otherwise enlarges, rods 24 are caused to unwind, with the inner ends 50 of rods 24 rising with hub 22. The rods 24, being flexed from the positions shown in FIG. 1, store energy and are self-biased to return from the configuration of FIG. 2 to the configuration of FIG. 1. If membrane 26 is of elastomeric material, the membrane also stores energy and is biased to return to the configuration of FIG. 1.

When it is desired to launch a missile, outlet 56 is opened, relaxing the pressure of the contained fluid. The outlet 56 may be in communication with a flow control valve, not shown herein, but illustrated in the aforementioned Bissonnette patents. The rods 24 immediately return to their FIG. 1 configuration. If the membrane 26 is of elastomeric material, it too, of its own accord returns to the configuration of FIG. 1. If the membrane is of non-elastomeric material, it is forced into the FIG. 1 configuration by the action of rods 24. In either mode of operation, the water within the pump is jetted from the pump very rapidly and under pressure, providing a "shot" of rapid flowing water to the missile launch tube to carry a missile therein out the tube and clear of the launching submarine.

Figure 5:
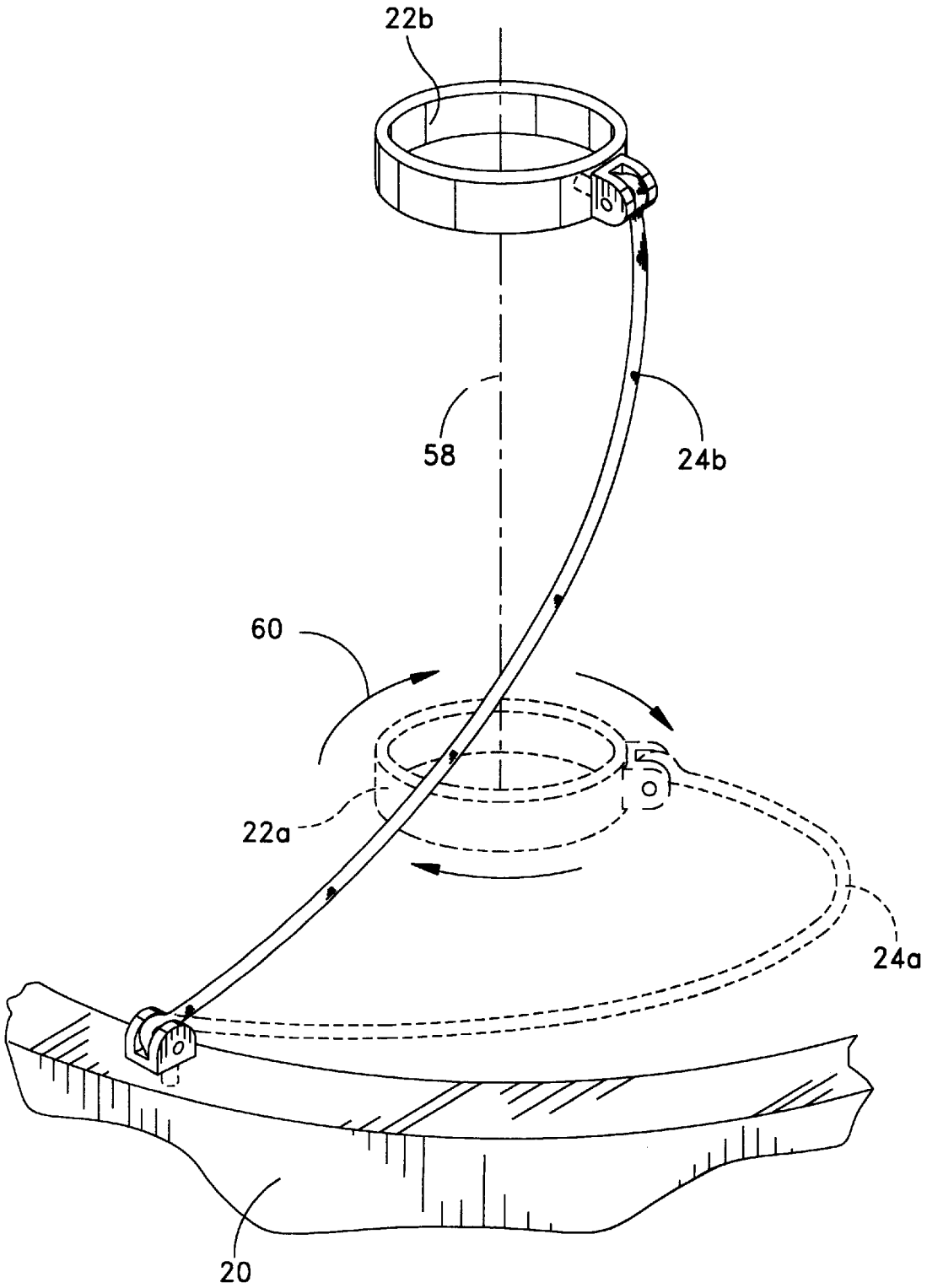
FIG. 5 is a diagrammatic perspective view of a rod portion of the pump of FIGS. 1 and 2.

In FIG. 5, there is shown the position 24*a* of one rod before enlargement of the pump, and the position 24*b* of the rod after enlargement of the pump. While hub 22 remains in the same axis 58, the upward movement of hub 22 and rods 24 causes the hub to rotate from the position 22*a* to the position 22*b*, the hub rotating about axis 58 in the direction indicated by arrows 60. The length of rods 24 remains constant, but each rod 24 undergoes twisting and bending in the process of moving from position 24*a* to position 24*b*, storing energy due to these strains.

Figure 6:
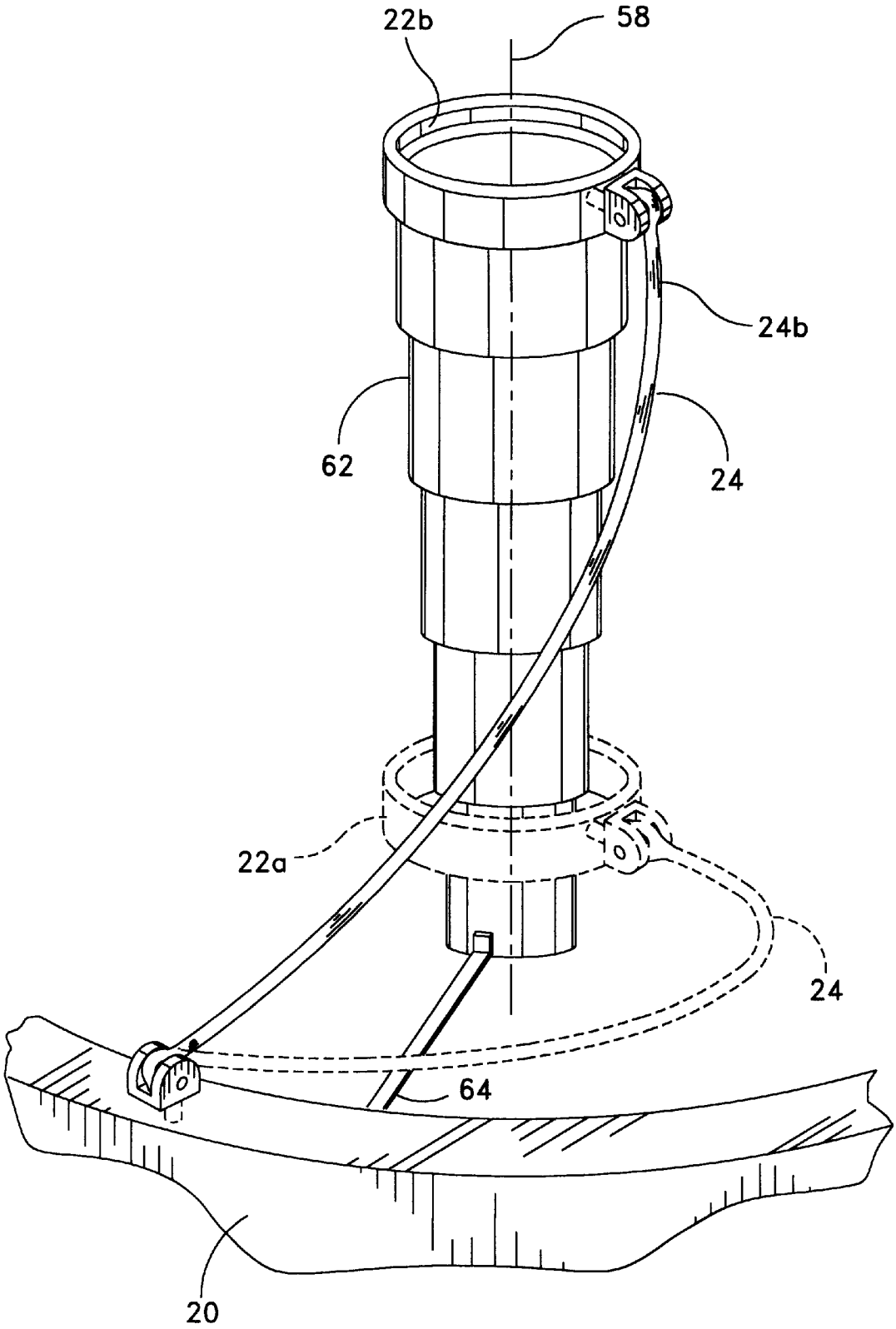
FIG. 6 is similar to FIG. 5 but illustrative of an alternative embodiment.

In FIG. 6, there is shown an alternative embodiment in which hub 22 is prevented from rotating about its axis 58, as by mechanical means such as telescoping cylinder 62 attached to hub 22 and band 20 by attachment arms 64, one of which is shown in FIG. 6. Inasmuch as hub 22 does not rotate, rods 24, which are not rotatable about their axes 28, as described for FIG. 4, are forced to twist about their axes 28 to a greater degree than the embodiment of FIG. 5, storing more energy in rods 24, which exert a greater force on contained water when mobilized by release of water through outlet 56.

Figure 7:
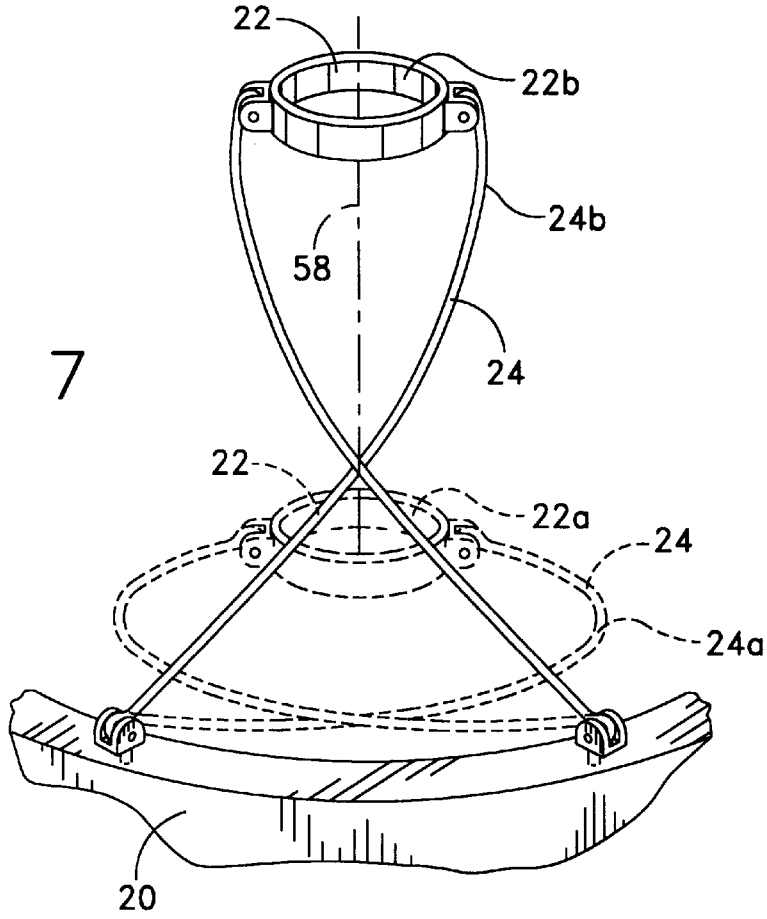
FIG. 7 is similar to FIG. 6 but illustrative of another alternative embodiment.
Figure 8:
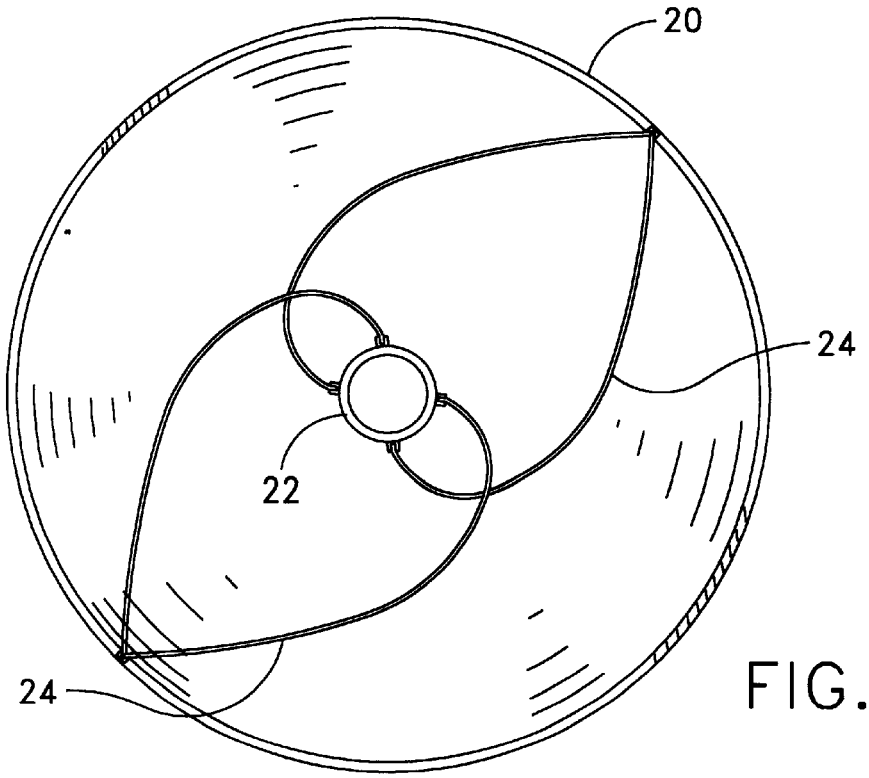
FIG. 8 is a diagrammatic top view of the embodiment of FIG. 7.

In FIGS. 7 and 8, there is shown another alternative embodiment wherein hub 22 is substantially held from rotating about its axis 58 not by separate mechanical means, but by opposite rods 24, such that as hub 22 rises from position 22*a* to position 22*b*, the opposing rods 24 also rise commensurately from positions 24*a* to positions 24*b*, keeping hub 22 from rotating about axis 58.

Figure 9:
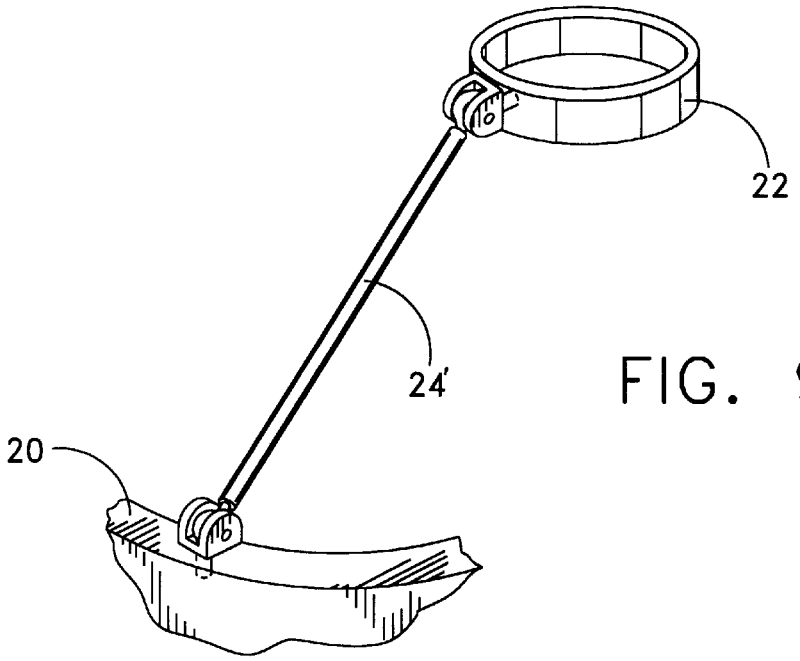
FIG. 9 is a diagrammatic view of another rod arrangement.

In FIG. 9, there is shown still another alternative embodiment, in which rods 24' are substantially straight, rather than spirally wound, but can elevate by pivoting about their respective pins 38, 52 (FIG. 4) and rotate about their respective posts 32, 44 and twist (but not rotate) about their axes 28 during enlargement of the pump and, upon release, immediately revert back to their original configuration, pulling hub 22 downwardly and flattening member 26.

Figure 10:
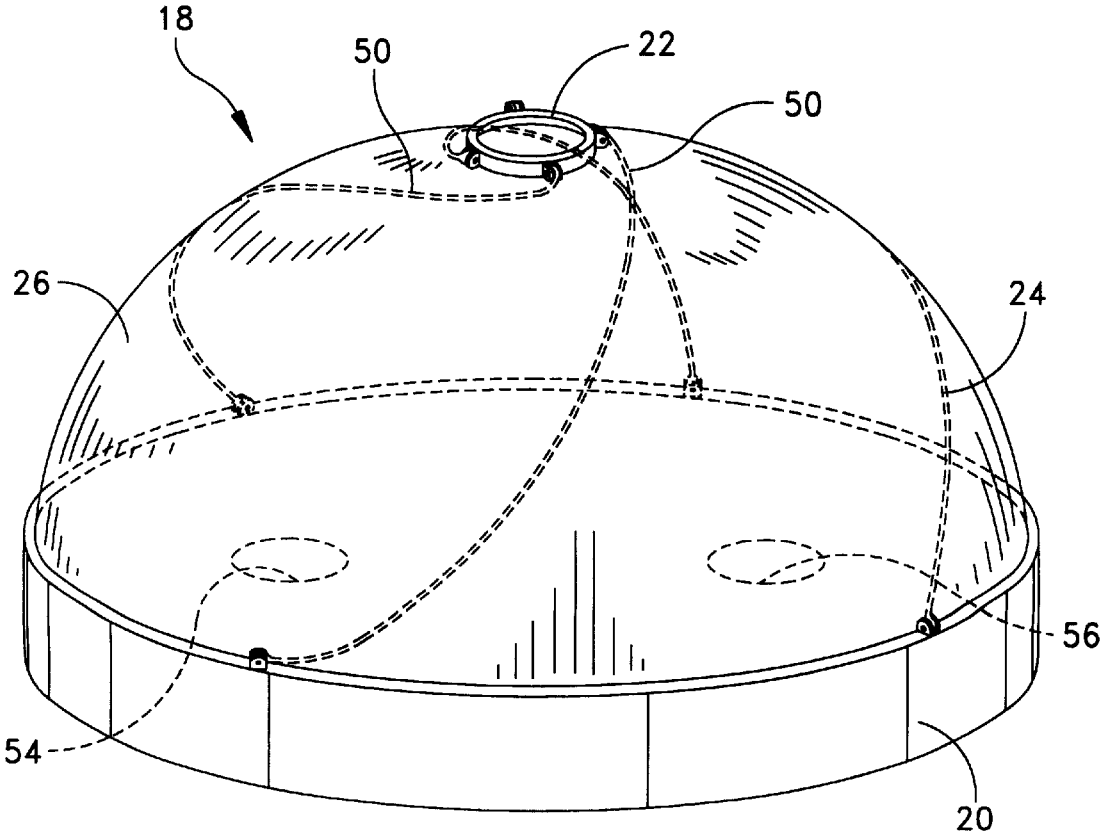
FIG. 10 is similar to FIG. 2 but illustrative of still another alternative embodiment.

As is shown in FIG. 10, rods 24 and hub 22 may be embedded in membrane 26, rather than overlie the membrane.

There is thus provided a fluid pump and expandable energy storage device which provides reliability and durability, and which provides the required strain energy but with limited elongation of the membrane, inasmuch as the rods store more energy in a relatively short elongation than do elastomeric bulbs in relatively extended elongations.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A fluid pump and expandable energy storage device comprising:

a substantially rigid circular band;

a substantially rigid central hub;

a membrane fixed to said band and to said hub, said membrane being enlargeable by a fluid introduced into said device; and a plurality of elastic rods interconnecting said band and said hub, said enlargeable membrane being adjacent said rods, such that enlargement of said membrane causes movement of said hub and portions of said rods away from a plane of said band, said rods undergoing strain to accomodate said movement, said strain biasing said rods to return to their original positions, whereby upon release of the fluid, said rods immediately return to their original positions, forcing the fluid out of the device at a high velocity.

2. The device in accordance with claim 1 wherein said rods overlie said membrane.

3. The device in accordance with claim 1 wherein said rods are embedded in said membrane.

4. The device in accordance with claim 1 wherein;

said membrane and said rods in a non-enlarged state are substantially planar in configuration; and said membrane and said rods in an enlarged state are generally hemispherically-shaped.

5. The device in accordance with claim 1 wherein said membrane is of elastomeric material and, upon expansion, is biased to return to a non-expanded state.

6. The device in accordance with claim 1 wherein said rods are of a material selected from a group of materials consisting of steel, titanium, steel alloy, titanium alloy, and composites of metal and synthetic materials.

7. The device in accordance with claim 1 wherein said membrane is of substantially non-expandable material, and is of sufficient size to enlarge to contain a selected volume of fluid.

8. The device in accordance with claim 1 wherein said rods are spirally wound between said band and said hub.

9. The device in accordance with claim 2 wherein said rods are each fixed at an outer end thereof to said band by a clevis arrangement which permits said rod outer end to pivot about two axes but not to rotate about an axis of said rod.

10. The device in accordance with claim 9 wherein said rods are each fixed at an inner end thereof to said hub by a clevis arrangement which permits said rod inner end to pivot about two axes but not to rotate about said axis of said rod.

11. The device in accordance with claim 1 wherein said central hub is held from substantial rotation about its axis during said movement of said hub.

12. The device in accordance with claim 1 wherein said rods comprise opposing first and second sets of rods, said first set of rods biasing said central hub to rotate about its axis in a first direction, and said second set of rods biasing said central hub to rotate about said axis in a second direction opposite to said first direction, said first and second sets of rods effecting substantially equal and opposite biases on said central hub to substantially hold said central hub in a non-rotating condition during said movement of said hub.

* * * * *